US006840245B2

(12) United States Patent
Cappello

(10) Patent No.: US 6,840,245 B2
(45) Date of Patent: Jan. 11, 2005

(54) TRANSPARENT MEDICAL ACCESSORY

(76) Inventor: Tamara J. Cappello, 12833 Smalley Ave., Grandview, MO (US) 64030

( * ) Notice: Subject to any disclaimer, the term of this patent is extended or adjusted under 35 U.S.C. 154(b) by 287 days.

(21) Appl. No.: 10/152,703

(22) Filed: May 21, 2002

(65) Prior Publication Data

US 2003/0217491 A1 Nov. 27, 2003

(51) Int. Cl.[7] ..... A61G 15/00
(52) U.S. Cl. ..... 128/845; 128/846
(58) Field of Search ..... 128/845, 846, 128/869; 362/101, 96, 20

(56) References Cited

U.S. PATENT DOCUMENTS 4,034,493 A * 7/1977 Ball ..... 40/106.21
4,106,079 A 8/1978 Drury
4,196,899 A * 4/1980 Patterson ..... 272/1 R
D283,370 S 4/1986 Hill
4,941,590 A 7/1990 Pantaleo et al.
4,967,322 A 10/1990 DuBois
5,056,821 A 10/1991 Fierro
5,538,455 A 7/1996 James, II
5,803,580 A * 9/1998 Tseng ..... 362/96
6,155,411 A 12/2000 Ho
6,206,536 B1 * 3/2001 Lin ..... 362/101
6,241,095 B1 6/2001 Yencheng
6,280,051 B1 * 8/2001 Wallach ..... 362/202
6,604,835 B2 * 8/2003 Zale ..... 362/101

* cited by examiner

*Primary Examiner*—Michael A. Brown
(74) *Attorney, Agent, or Firm*—Dale J. Ream

(57) ABSTRACT

A transparent article includes a sealed tubular member constructed of a transparent material and having first and second closed ends. The tubular member is substantially filled with a liquid. A plurality of decorative structures, such as plastic fish, are submersed in the liquid, each decorative structure having a predetermined density so as to be loosely suspended at a generally predetermined vertical position within the liquid according to a density of the liquid itself. The transparent article may be used as a bed rail component, mounted to a wheeled base and used as an IV stand, or as a vertical support of a crutch.

20 Claims, 7 Drawing Sheets

TRANSPARENT MEDICAL ACCESSORY

BACKGROUND OF THE INVENTION

This invention relates generally to articles of manufacture having hollow chambers and, more particularly, to medical accessories having at least one transparent hollow tube in which decorative structures having predetermined material densities are loosely suspended in a liquid so as to encourage a child using the medical accessory.

While a serious illness, hospital stay, or temporary disability such as a broken leg can be a difficult emotional experience for anyone, it is especially difficult for young children. Various devices and methods for decorating hospital rooms and medical equipment are known. Although assumably effective for their intended purposes, the existing devices and methods do not provide medical equipment having transparent chambers in which decorative structures, such as fish, stars, confetti, and the like are loosely suspended and distributed.

Therefore, it is desirable to have a transparent medical accessory that includes a plurality of decorative structures loosely suspended in a liquid contained in a transparent tubular member. Further, it is desirable have a transparent medical accessory in which suspended decorative structures may be novelties that are encouraging and attractive to children.

SUMMARY OF THE INVENTION

A transparent medical accessory according to the present invention includes at least one hollow tubular member having closed ends and substantially filled with a liquid. A plurality of decorative structures is submersed in the liquid, each structure having a predetermined material density that determines its relative vertical position within the liquid. However, the decorative structures are not stationary; rather, they are loosely suspended in the liquid relative to the densities of the structures and liquid and have a range of motion according to movement and orientation of the liquid. In various embodiments of the transparent medical accessory, the transparent tubular member may be used as a bed rail (e.g. for a hospital bed), as the upstanding shaft of an IV stand, or in combination with additional tubular members as support members of a crutch.

Therefore, a general object of this invention is to provide a transparent medical accessory that provides emotional encouragement or entertainment to children using the accessory.

Another object of this invention is to provide a transparent medical accessory, as aforesaid, in which decorative or novelty structures are loosely suspended in a liquid contained in a transparent tubular member.

Still another object of this invention is to provide a transparent medical accessory, as aforesaid, in which each decorative structure includes a predetermined material density so that it is loosely suspended at a generally predetermined vertical position in the liquid contained in the tubular member.

Yet another object of this invention is to provide a transparent medical accessory, as aforesaid, in which the predetermined material density of each decorative structure is established using gas-assisted injection molding.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
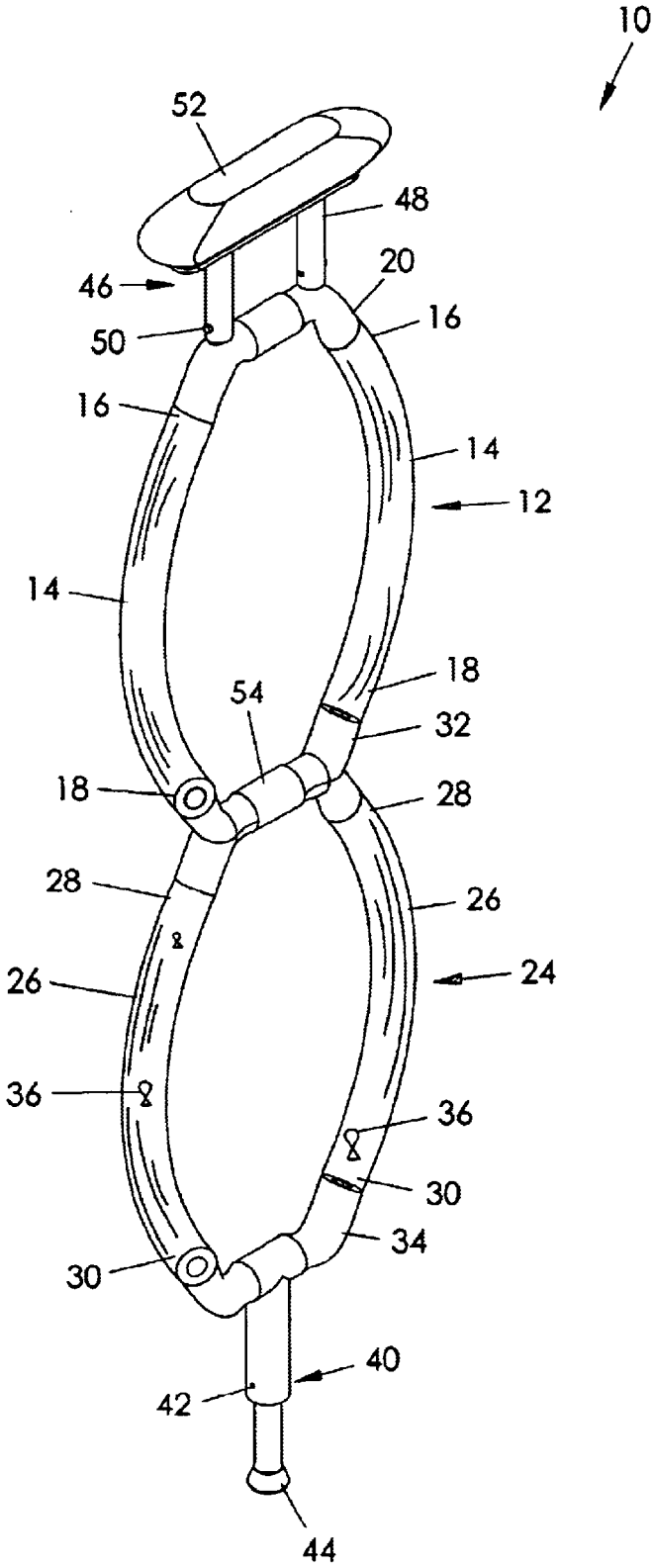
FIG. 1 is a perspective view of a transparent medical accessory according to one embodiment of the present invention.

A transparent medical accessory according to the present invention will now be described in detail with reference to FIGS. 1 through 7 of the accompanying drawings. A transparent medical accessory 10 according to one embodiment of the present invention is shown particularly in FIGS. 1 through 5 and includes multiple hollow tubular members utilized as support members of a crutch (FIG. 1).

Figure 2:
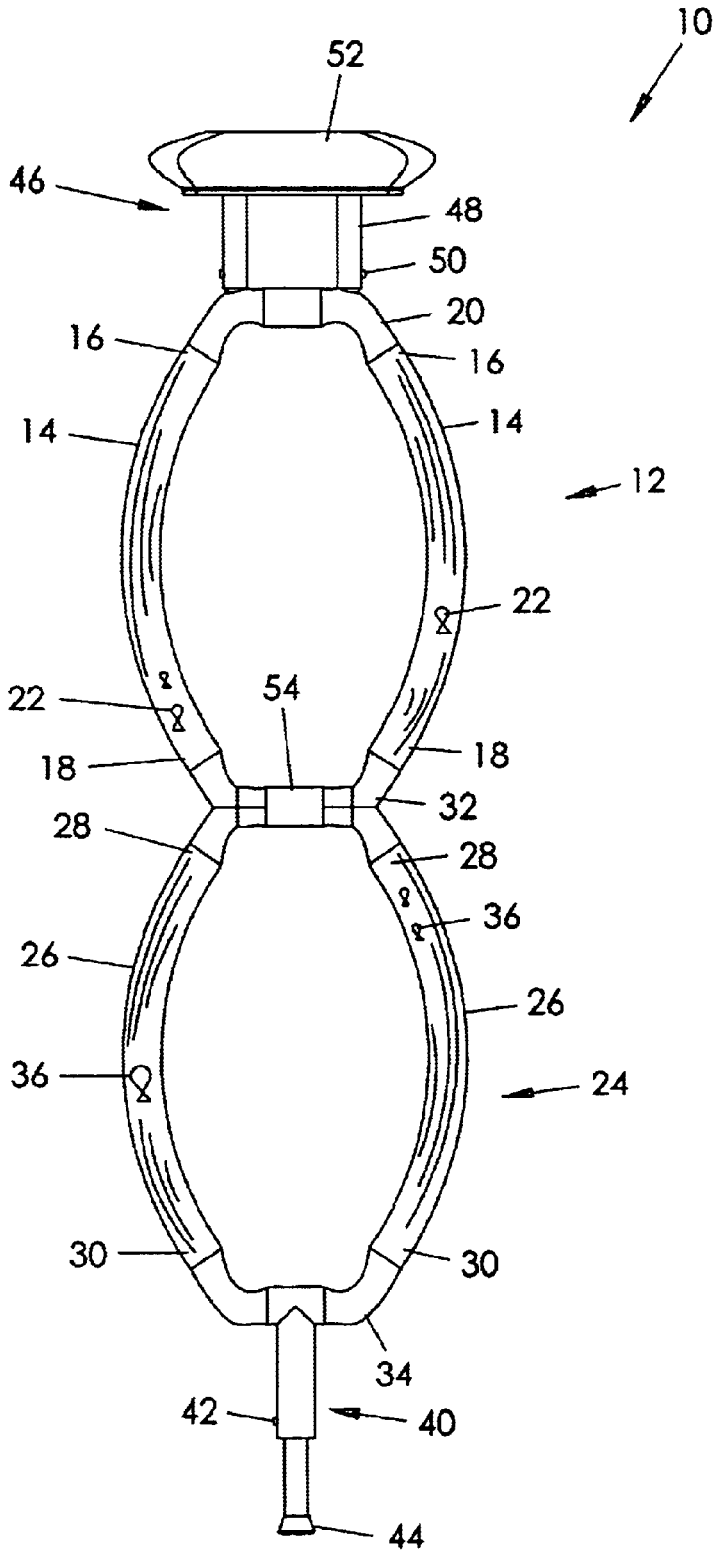
FIG. 2 is a front view of the accessory as in FIG. 1.

More particularly, the accessory 10 includes an upper support assembly 12 having a pair of upper tubular members 14, each upper tubular member having upper 16 and lower 18 ends and being constructed of a transparent material such as polycarbonate utilizing an injection blow molding process. Upper ends 16 of the upper tubular members 14 are connected together with a first coupling 20 so as to maintain the upper ends in a spaced apart relation. Preferably, each of the upper tubular members 14 includes a generally arcuate configuration, the pair of upper tubular members being arranged in an oppositely disposed and outwardly arcuate symmetrical configuration (FIG. 2).

Each of the upper tubular members 14 contains a liquid having a generally low specific gravity, such as a saline solution although a water/glycerin solution would also work. Each upper tubular member 14 is substantially filled with a quantity of this liquid. A plurality of decorative structures 22 is submersed in this liquid, the structures being configured as animals, stars, confetti, etc. Each decorative structure 22 preferably includes a polyethylene construction that is injection molded although other plastic materials would be suitable. More particularly, gas-assisted injection molding is preferred so as to inject a predetermined percentage of a gas, such as nitrogen, into each decorative structure 22. Therefore, each decorative structure 22 includes a predetermined material density determinative of its relative vertical position suspended in the liquid. For example, if a small amount of nitrogen was added to a decorative structure 22, the structure would float to the top of the tubular member, and vice versa. Each decorative structure 22 may have a density different than a density of any other structure.

However, it should be appreciated that this predetermination of a decorative structure's material density does not render the decorative structure 22 stationary in the liquid. The decorative structures 22 are suspended loosely in the liquid and are free to turn, move laterally, and even move vertically according to movements and orientation of the overall accessory 10. The predetermined densities of the decorative structures 22 simply allow the structures to be distributed throughout the tubular member and to maintain a generally predetermined position according to its own density and a density of the liquid.

Upper 16 and lower 18 ends of each upper tubular member 14 are closed such that each tubular member forms an independent sealed environment although it would also be suitable for the upper ends to be open whereby the liquid in the upper tubular members may be communicated through the first coupling 20.

The transparent medical accessory 10 further includes a lower support assembly 24 having a pair of lower tubular members 24, each lower tubular member having upper 28 and lower 30 ends. The lower tubular members 24 include a construction substantially similar to the construction of the upper tubular members 14 described previously, including a generally arcuate configuration and opposed outwardly symmetrical arrangement (FIG. 2). A second coupling 32 connects both the lower ends 18 of the upper tubular members 14 and the upper ends 28 of the lower tubular members 24. Accordingly, the upper and lower support assemblies are coupled together. A third coupling 34 connects the lower ends 30 of the lower tubular members 24. Each of the lower tubular members 24 contains a second quantity of the low specific gravity liquid and a second plurality of decorative structures 36 is submersed therein. The construction and function of the second plurality of decorative structures 36 is substantially the same as that of the first plurality of decorative structures 22 described previously. Although a lower support assembly 24 has been shown and described, it is understood that a single pair of opposed tubular members (i.e. a single support assembly) would be suitable.

Figure 5:
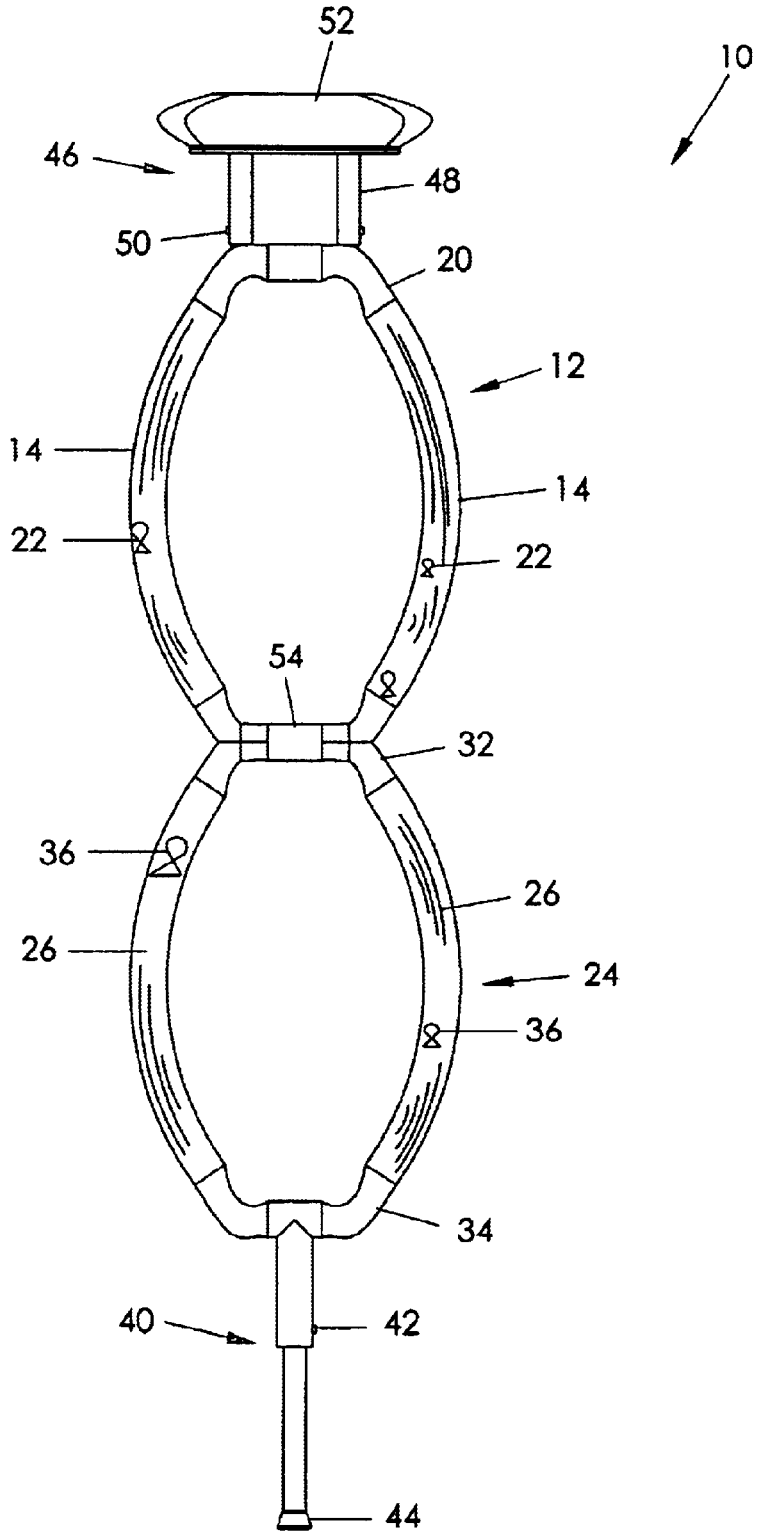
FIG. 5 is a front view of the accessory as in FIG. 2 with the support leg in an extended configuration.

A length-adjustable support leg 40 is fixedly attached to the third coupling 34 and is thus connected to the lower ends 30 of the lower tubular members 24. More particularly, the length-adjustable support leg 40 includes a first portion depending from the third coupling 34 and a second portion slidably received in the first portion. The second portion defines a plurality of apertures (not shown) while the first portion defines a single aperture adjacent an open end thereof. Therefore, the second portion may be releasably locked at a desired length with a spring-loaded pin 42 or other similar fastener inserted through selected apertures (FIG. 5). A rubber stopper 44 is coupled to a free end of the second portion of the support leg 40 for reducing slippage of the support leg 40 on a support surface.

Figure 3:
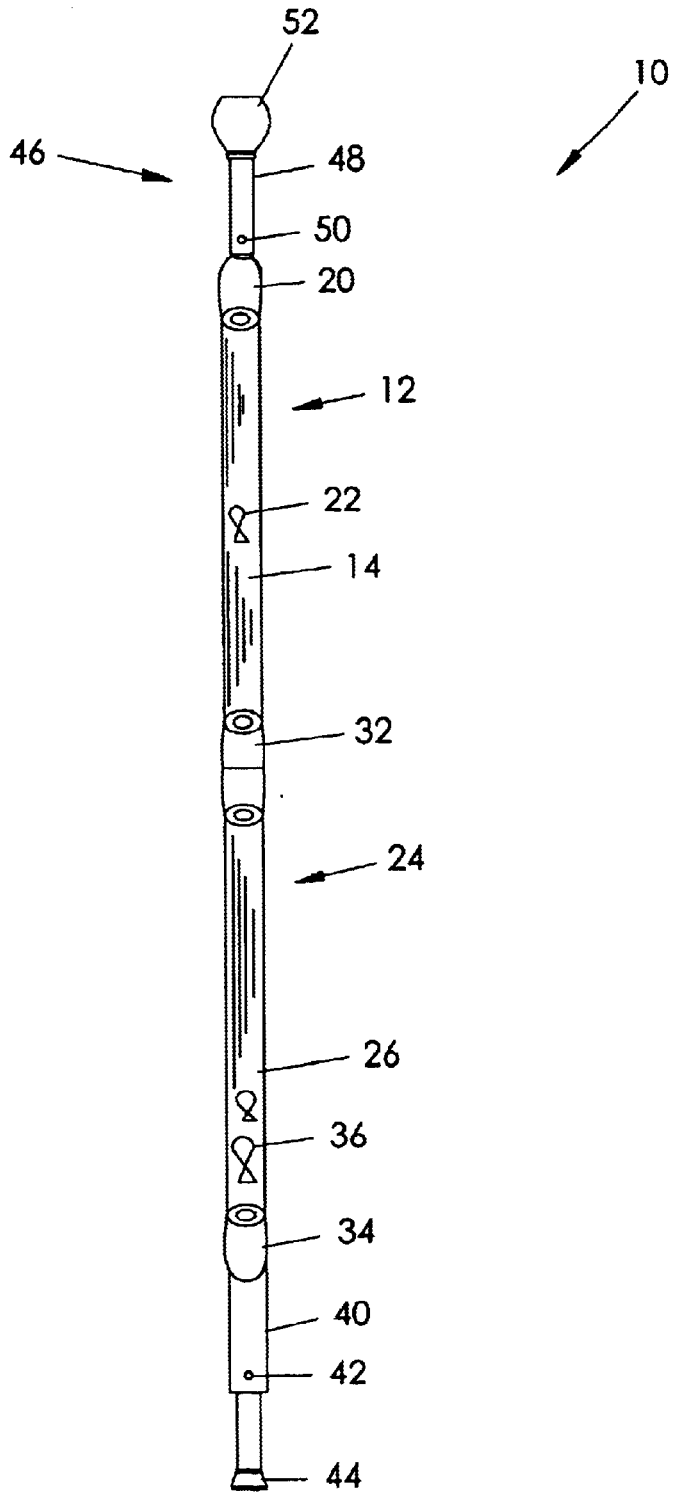
FIG. 3 is a side view of the accessory as in FIG. 1.
Figure 4:
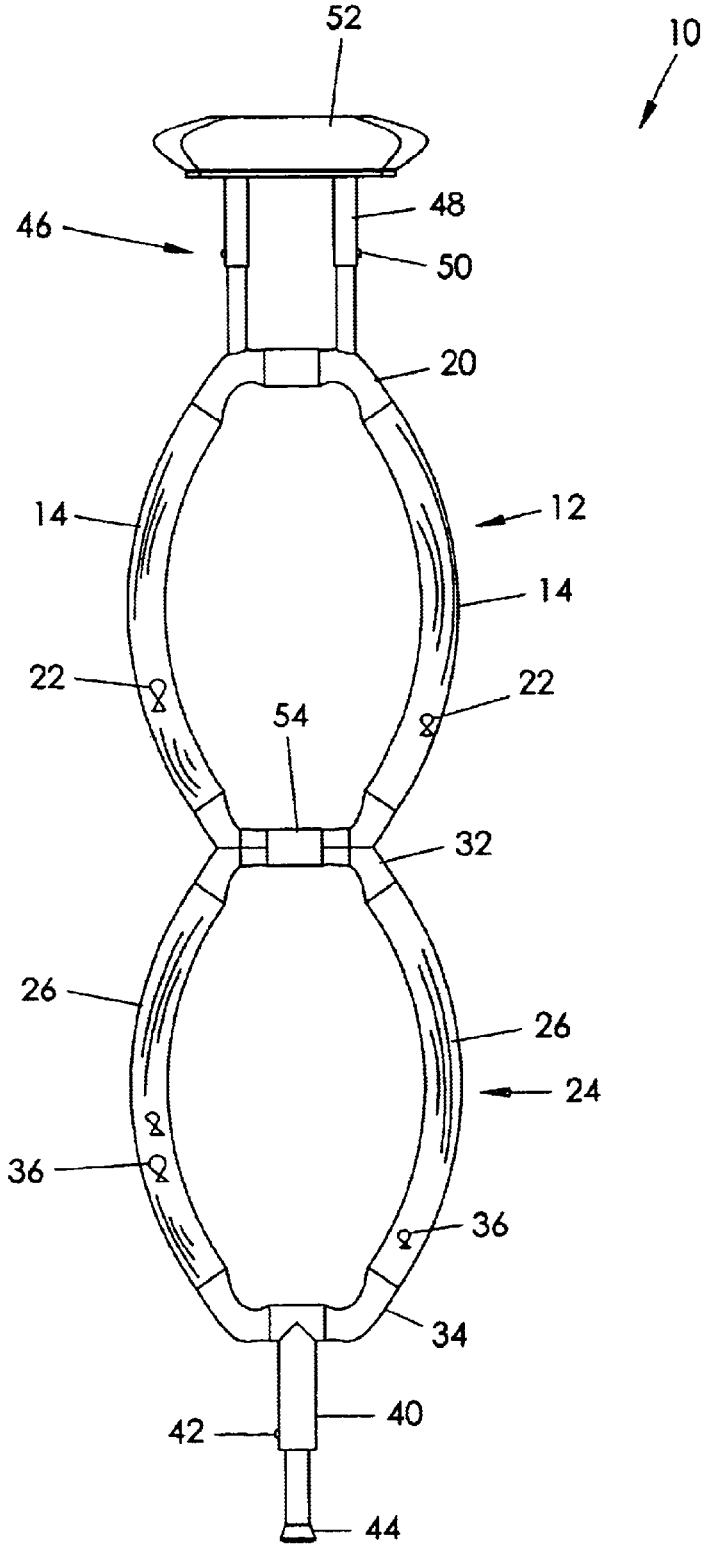
FIG. 4 is a front view of the accessory as in FIG. 2 with the armrest assembly in an extended configuration.

The transparent medical accessory 10 further includes an armrest assembly 46 situated atop the upper support assembly 12. More particularly, the armrest assembly 46 includes a pair of length-adjustable support posts 48 attached to the first coupling 20 and extending upwardly therefrom (FIG. 1). Each support post 48 includes a construction substantially similar to the construction of the length-adjustable support leg 40 described previously. Therefore, the support posts 48 are movable between retracted (FIG. 2) and extended (FIG. 4) configurations using spring-loaded pin 50 mechanisms (FIG. 3). An armrest 52 is fixedly attached to the top of the support posts 48 and includes a soft rubber construction having a configuration suitable for receiving the underarm of a person. Of course, the armrest 52 may included a padded material construction.

The second coupling 32 forms a handle 54 extending between opposed tubular members at a point longitudinally intermediate the first 20 and third 34 couplings. In other words, the handle 54 is positioned at the point where the upper support assembly 12 is coupled to the lower support assembly 24 (FIG. 2). Of course, the handle may include a padded grip.

Figure 6:
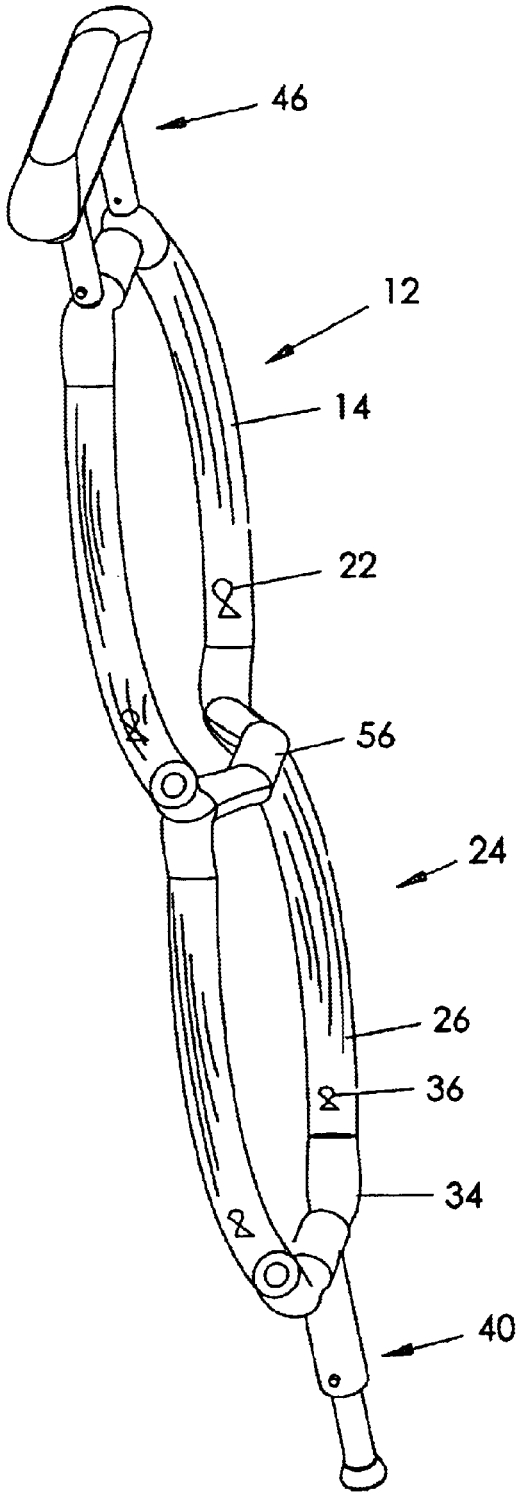
FIG. 6 is a perspective view of a transparent medical accessory according to another embodiment of the present invention.

Alternatively, the second coupling 32 may present an offset configuration so as to include a handle 56 that extends outside of an imaginary vertical plane defined by the upper 12 and lower 24 support assemblies (FIG. 6). With the handle 56 being offset from the plane of the armrest assembly, the user has more control over crutch movements as well as a more comfortable grip. The offset handle 56 enables a user to make use of his palms for support and control of the crutch rather than a constant use of the thumbs as in a traditional crutch design which causes frequent blisters.

In use, a user may be entertained by viewing the loosely suspended decorative structures 22, 36 "swimming" in the liquid contained within the tubular members 14, 26. Even the slightest movement of the tubular members by a user will cause movement or positional variation of the decorative structures 22, 36 although the relative densities of the structures and liquid will cause the decorative structures 22, 36 to ultimately return to respective generally predetermined positions. Of course, the length-adjustable armrest assembly 46 and support leg 40 may be vertically adjusted as desired.

Figure 7:
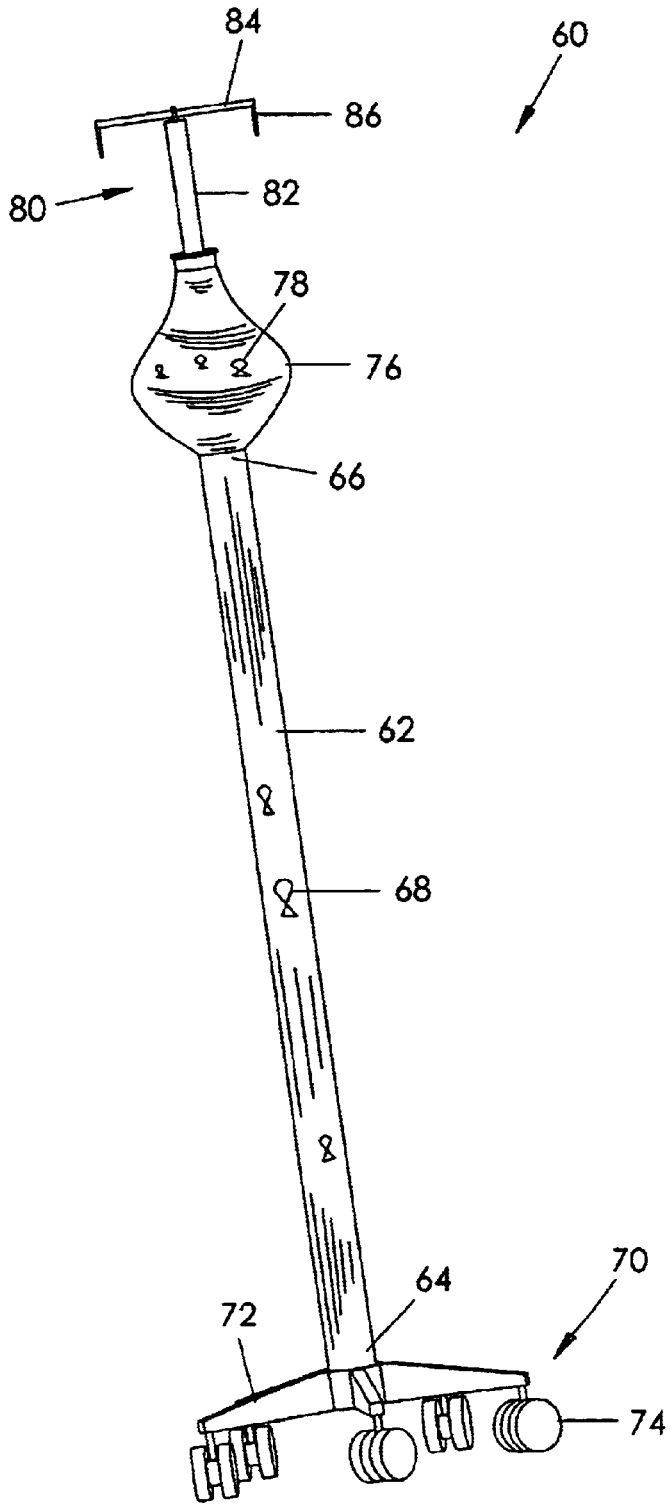
FIG. 7 is a perspective view of a transparent medical accessory according to still another embodiment of the present invention.

Another embodiment of a transparent medical accessory 60 according to this invention is shown in FIG. 7 and includes a construction substantially similar to the construction of the embodiment first described above except as specifically noted below. This embodiment includes a single tubular member 62 constructed of a transparent material and having first 64 and second 66 closed ends so as to form a sealed container. The tubular member 62 is substantially filled with a low specific gravity liquid in which a plurality of decorative structures 68 are submersed and loosely suspended as described above. The medical accessory 60 according to this embodiment includes a base assembly 70 having a plurality of spaced apart legs 72 extending radially about the first end 64 of the tubular member 62, the base assembly 70 including a plurality of casters 74 rotatably coupled to respective legs 72. The tubular member 62 is supported vertically upon the base assembly 70 such that the tubular member 62 may be moved along a support surface as desired. Therefore, this tubular member 62 acts as a main support shaft of an IV stand. This medical accessory 60 further includes an auxiliary reservoir 76 attached atop the second end 66 of the tubular member 62, the auxiliary reservoir being constructed of a transparent material and having a generally bulbous configuration. The auxiliary reservoir 76 further defines an interior chamber containing another quantity of the low specific gravity liquid and having another plurality of decorative structures 78 suspended therein as previously described. The accessory 60 further includes an intravenous fluid holder 80 having a support rod 82 attached to a top of the auxiliary reservoir 76 and a bracket 84 coupled to a free end of the support rod 82. The bracket 84 includes hooks 86 or other suitable fasteners capable of holding at least one intravenous fluid container. Therefore, the medical accessory 60 according to this embodiment acts as an IV stand that provides encouragement or entertainment to a child who is a hospital patient.

Still another embodiment of this invention (not shown) includes a single hollow tubular support member constructed of a transparent material and having closed ends. A quantity of an appropriate liquid is sealed within the tubular member and includes a plurality of decorative structures loosely suspended in the liquid as previously described. This embodiment is particularly adapted to be utilized as a bed rail of a hospital bed.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A transparent apparatus, comprising:

an elongate sealed tubular member constructed of a transparent material and having first and second closed ends;

a liquid contained in said tubular member; and a plurality of decorative structures submersed in said liquid, each decorative structure having a predetermined density different from a density of any other said decorative structures so as to be loosely suspended at a predetermined vertical position in said liquid according to a density of said liquid.

2. The transparent apparatus as in claim 1 wherein each decorative structure is gas-assisted injection molded with a predetermined amount of nitrogen whereby to establish a predetermined material density.

3. The transparent apparatus as in claim 1 further comprising:

a base assembly having a plurality of spaced apart legs extending radially about said first end of said tubular member, said base assembly including a plurality of casters rotatably coupled to respective legs, whereby to support said tubular member upon a support surface;

a sealed auxiliary reservoir constructed of a transparent material and having a bulbous configuration, said auxiliary reservoir being coupled to said second end of said tubular member;

another liquid contained in said auxiliary reservoir; and another plurality of decorative structures submersed in said another liquid, each of said another plurality of decorative structures having a predetermined density determinative of a general vertical position thereof in said another liquid.

4. The transparent apparatus as in claim 1 further comprising:

another sealed tubular member constructed of a transparent material and having first and second closed ends;

another liquid contained in said another tubular member;

another plurality of decorative structures submersed in said another liquid, each of said another plurality of decorative structures having a predetermined density determinative of a general vertical position thereof in said another liquid;

a length-adjustable leg coupled to respective first ends of said tubular member and said another tubular member; and an arm rest assembly having a pair of length-adjustable support posts coupled to respective second ends of said tubular member and said another tubular member, said arm rest assembly having a padded arm rest positioned atop said pair of support posts.

5. The transparent apparatus as in claim 4 further comprising a handle member extending between said tubular member and said another tubular member at a point intermediate respective first and second ends thereof.

6. The transparent apparatus as in claim 5 wherein said handle member includes an offset configuration wherein said handle member extends outside of an imaginary vertical plane defined by said tubular member and said another tubular member.

7. A transparent medical accessory, comprising:

a base assembly adapted to contact a support surface;

a first tubular member constructed of a transparent material and having first and second closed ends, said first end being coupled to said base assembly such that said first tubular member is supported upon said base assembly;

a first liquid contained in said first tubular member;

a first plurality of decorative structures submersed in said first liquid, each of said first plurality of decorative structures having a predetermined density different from a density of any other of said first plurality of decorative structures so as to be loosely suspended at a predetermined vertical position in said liquid according to a density of said liquid; and means attached to said second end of said first tubular member for supporting the weight of an article or person.

8. The transparent medical accessory as in claim 7 wherein said base assembly includes:

a plurality of spaced apart legs extending radially about said first end of said first tubular member; and a plurality of casters rotatably coupled to respective legs.

9. The transparent medical accessory as in claim 8 wherein said supporting means is an intravenous fluid holder, said intravenous fluid holder having a support rod coupled to said second end of said first tubular member and a bracket coupled to said support rod, said bracket adapted to retain at least one intravenous fluid container.

10. The transparent medical accessory as in claim 8 further comprising:

a sealed auxiliary reservoir constructed of a transparent material and defining a chamber, said auxiliary reservoir being connected to said second end of said first tubular member;

a second liquid contained in said chamber of said auxiliary reservoir;

a second plurality of decorative structures, each of said second plurality of decorative structures having a predetermined density so as to be loosely suspended at a predetermined vertical position in said second liquid according to a density of said second liquid.

11. The transparent medical accessory as in claim 7 wherein said base assembly includes a length-adjustable leg.

12. The transparent medical accessory as in claim 11 further comprising:

a second tubular member having a transparent construction and opposed first and second ends, respective first ends of said first and second tubular members being coupled to said length-adjustable leg, said first tubular member defining an imaginary vertical axis parallel to an imaginary vertical axis defined by said second tubular member;

a second liquid contained in said second tubular member; and a second plurality of decorative structures submersed in said second liquid, each of said second plurality of decorative structures having a predetermined density so as to be loosely suspended at a predetermined vertical position in said second liquid according to a density of said second liquid.

13. The transparent medical accessory as in claim 12 wherein said supporting means includes an arm rest assembly, said arm rest assembly having a pair of length-adjustable support posts coupled to respective second ends of said first and second tubular members and having a padded arm rest situated atop said pair of length-adjustable support posts.

14. The transparent medical accessory as in claim 12 further comprising a handle member extending between said first and second tubular members at a point intermediate respective first and second ends thereof.

15. The transparent medical accessory as in claim 14 wherein said handle member includes an offset configuration in which said handle member extends outside of an imaginary vertical plane defined by said first and second tubular members.

16. A transparent medical accessory, comprising:

a pair of upper tubular members, each upper tubular member having upper and lower ends;

a first quantity of a liquid contained in said pair of upper tubular members;

a first plurality of decorative structures submersed in said first quantity of said liquid, each of said first plurality of decorative structures having a predetermined density determinative of a general vertical position thereof in said first quantity of said liquid;

a pair of lower tubular members, each lower tubular member having upper and lower ends;

wherein respective upper ends of said lower tubular members are connected to respective lower ends of said upper tubular members;

a second quantity of said liquid contained in said pair of lower tubular members;

a second plurality of decorative structures submersed in said second quantity of said liquid, each of said second plurality of decorative structures having a predetermined density determinative of a general vertical position thereof in said second quantity of said liquid;

a support leg connected to respective lower ends of said pair of lower tubular members; and an armrest assembly connected to respective upper ends of said pair of upper tubular members.

17. The transparent medical accessory as in claim 16 wherein:

said support leg is length-adjustable; and said armrest assembly includes a pair of length-adjustable support posts coupled to respective upper ends of said pair of upper tubular members and a padded armrest attached atop said support posts.

18. The transparent medical accessory as in claim 16 further comprising:

a first coupling fixedly attached to respective upper ends of said pair of upper tubular members;

a second coupling fixedly attached to respective lower ends of said pair of upper tubular members and to respective upper ends of said pair of lower tubular members;

a third coupling fixedly attached to respective lower ends of said pair of lower tubular members;

said first, second, and third couplings adapted to maintain respective pairs of upper and lower tubular members in spaced relation; and said respective pairs of upper and lower tubular members having opposing arcuate configurations.

19. The transparent medical accessory as in claim 16 further comprising a handle member extending between respective lower ends of said pair of upper tubular members.

20. The transparent medical accessory as in claim 19 wherein said handle member includes an offset configuration in which said handle member extends outside of an imaginary vertical plane defined by said pair of upper tubular members.

* * * * *